US005988906A

United States Patent [19]

Arcaro et al.

[11] Patent Number: 5,988,906

[45] Date of Patent: Nov. 23, 1999

[54] INTEGRATED DUPLEXER FOR A LASER PRINTER

[75] Inventors: David J. Arcaro, Boise; Gary E. Hanson, Meridian, both of Id.

[73] Assignee: Hewlett-Packard Company, Palo Alto, Calif.

[21] Appl. No.: 08/938,199

[22] Filed: Sep. 26, 1997

[51] Int. Cl.[6] ..... B41J 13/03

[52] U.S. Cl. ..... 400/636.2; 400/637.1

[58] Field of Search ..... 400/636, 634, 400/636.2, 637.1, 582

[56] References Cited

U.S. PATENT DOCUMENTS 4,383,454 5/1983 Calabrese ..... 74/337.5

4,958,820 9/1990 Johdai et al. ..... 270/52

5,303,017 4/1994 Smith ..... 355/318

*Primary Examiner*—John Hilten

*Attorney, Agent, or Firm*—Lane R. Simmons

[57] ABSTRACT

An image forming device includes output rollers disposed for ejecting media out of the image forming device, and a single solenoid activated bi-directional output drive mechanism connected to the output rollers for bi-directionally driving the output rollers and for enabling a return path back through the output rollers for duplexing of the media. In an alternate embodiment, the image forming device includes substantially all components necessary for duplexing, integrated with the base engine of the image forming device, but excludes the solenoid activated bi-directional output drive mechanism, for providing a non-duplexing system that is optionally and easily upgradeable to a duplexing system.

14 Claims, 4 Drawing Sheets

INTEGRATED DUPLEXER FOR A LASER PRINTER

FIELD OF THE INVENTION

This invention relates in general to image forming devices and, more particularly, to duplexing features for laser printers.

BACKGROUND OF THE INVENTION

The art of duplexing, or printing on both sides of a sheet of paper (or other media), has long been reserved for higher end imaging devices, including inkjet printers, laser printers, photocopiers, etc. The complexities associated with duplex imaging are well known in the art. For example, U.S. Pat. No. 4,453,841 describes a Duplex Printing system And Method Therefor wherein multiple copy sheets are transported simultaneously through a sheet path. A copy sheet inverter receives the copy sheets sequentially from the sheet path after the sheets are printed on their first sides and returns them to the sheet path in an inverted orientation prior to printing on the second sides.

A separate implementation for duplexing is noted in U.S. Pat. No. 4,066,252 wherein after a sheet is printed on a first side, it is transported to an output accumulation tray, but then withdrawn therefrom and re-introduced into the paper path while at the same time being inverted for imaging on the second side.

Duplexing systems such as that described in the '841 patent are generally more complex, costly and faster than systems such as that described in the '252 patent. As such, duplexing systems that incorporate the technique of withdrawing the sheet from the output tray to return it for duplexing (similar to the description of the '252 patent) are generally implemented in lower end, lower cost systems, with the sacrifice of speed being exchanged for reduced cost. However, in either type of system, there is a continual effort to reduce costs, increase speed, and provide improved options for the customer.

To this end, it is also known in the art to implement duplexing systems by creating the duplexing feature as an add-on option to an already existing imaging system, such as a laser printer. This enables a lower cost non-duplexing system that can be subsequently upgraded to a duplexing system by the purchase of the add-on duplexer. However, these add-on type duplexers generally require separate drive motors and duplicate components relative to what already exist in the imaging system to which the add-on duplexer is added. Thus, overall costs may actually be greater than if the duplexer is purchased as an integrated feature of the original imaging system.

Accordingly, an object of the present invention is to enable a low cost duplexer through the integration of certain duplexing functionality into the base engine while retaining some add-on type capability.

SUMMARY OF THE INVENTION

According to principles of the present invention in a preferred embodiment, an image forming device, such as a laser printer, includes output rollers disposed for ejecting media out of the image forming device, and further includes a single solenoid activated bi-directional output drive mechanism (i.e., a reversing mechanism) connected to the output rollers for bi-directionally driving the output rollers and for enabling a return path back through the output rollers for duplexing of the media.

In an alternate embodiment, the image forming device includes substantially all components necessary for duplexing, integrated with the base engine of the image forming device, but excludes the solenoid activated bi-directional output drive mechanism, for providing a non-duplexing system that is optionally upgradeable to a duplexing system. Additionally, by strategically locating the bi-directional output drive mechanism on an accessible gear plate of the image forming device, the bidirectional output drive mechanism can be easily added during final engine integration or as a post-sale accessory at a minimum cost.

Other objects, advantages, and capabilities of the present invention will become more apparent as the description proceeds.

DETAILED DESCRIPTION OF THE INVENTION

Figure 1:
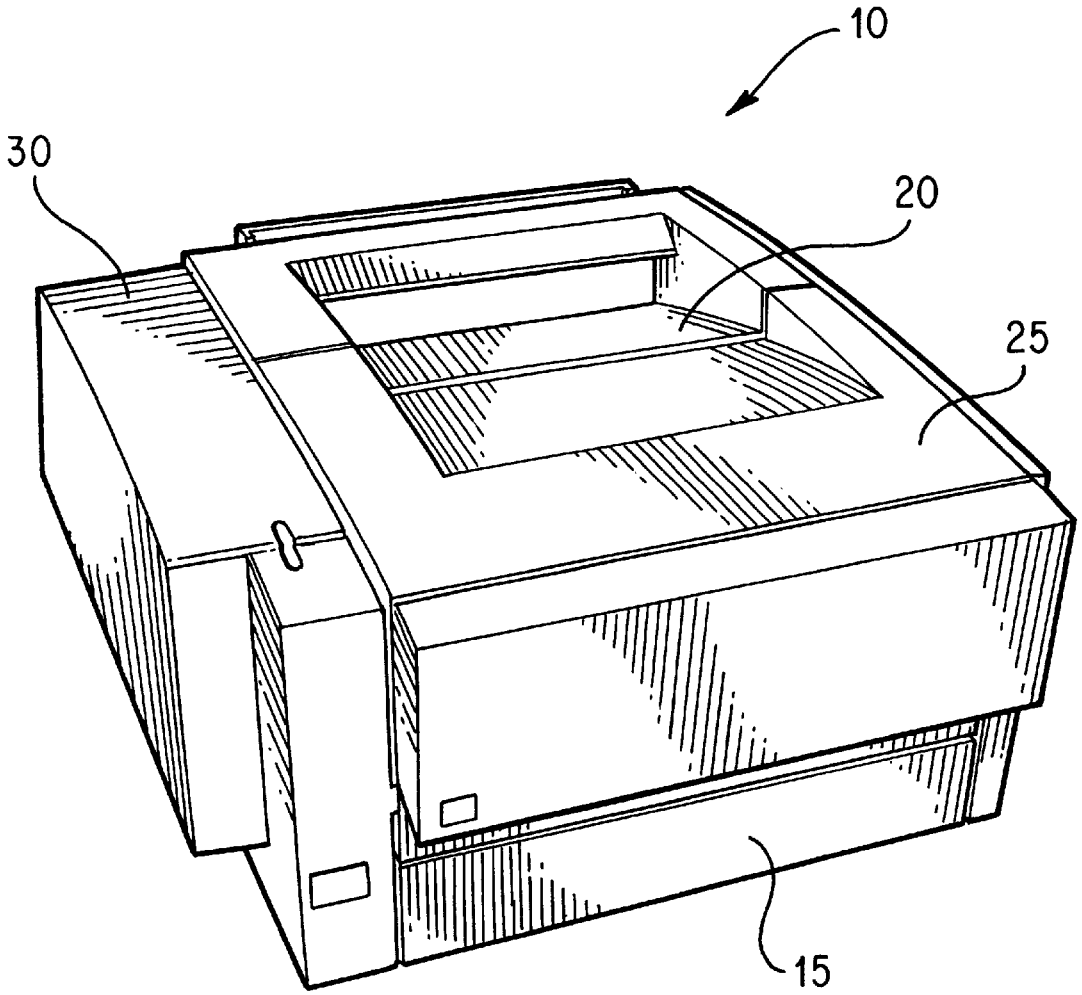
FIG. 1 is perspective view of a printer employing principles of the present invention.
Figure 2:
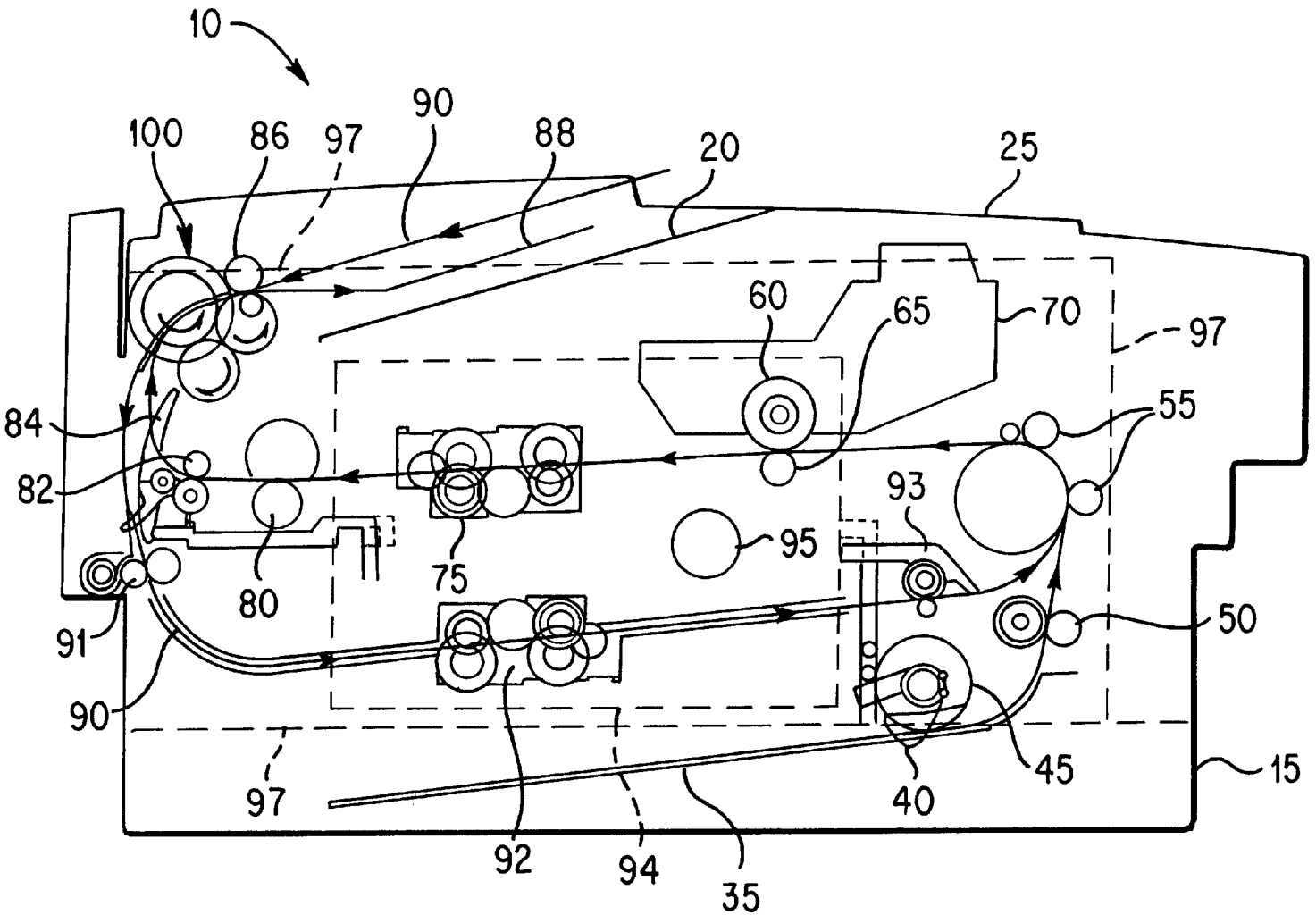
FIG. 2 is a side elevational view in schematic diagram of the printer of FIG. 1.
Figure 4:
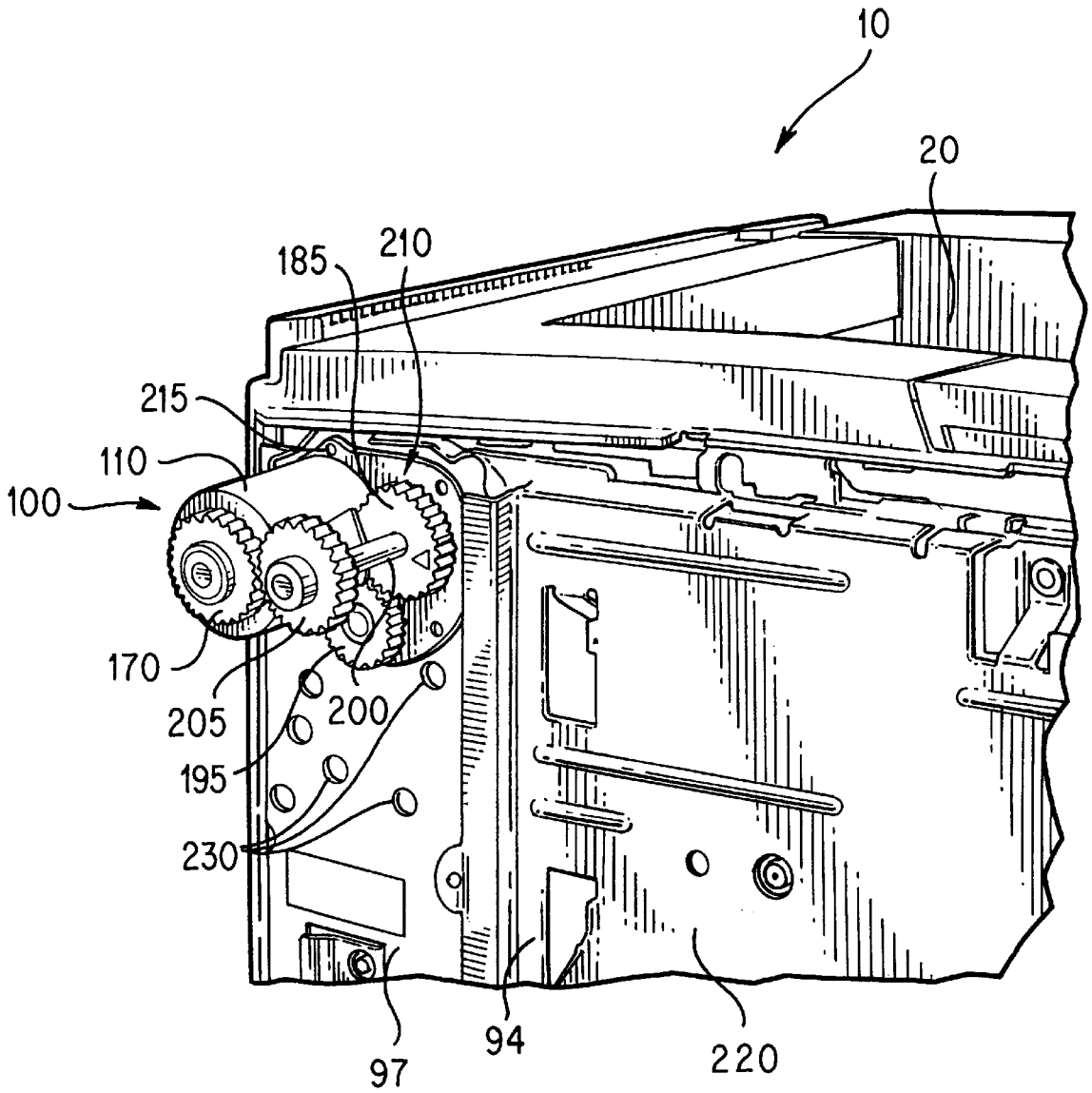
FIG. 4 is a partial perspective view of the printer of FIG. 1 with a cover panel removed and showing the output roller reversing mechanism of FIG. 3 for enabling duplexing.

FIG. 1 is perspective view of a printer 10 employing principles of the present invention. Although printer 10 is shown and discussed herein as a laser printer, it will be understood by those of ordinary skill in the art that the present invention is equally applicable to other image forming devices capable of duplex processing, such as inkjet printers, photocopiers, and the like. Printer 10 includes removable input tray 15 for holding sheet media (such as paper) to be processed through the printer. Printer 10 also includes output tray 20 for holding the sheet media after having been processed through the printer. The external housing of printer 10 includes access panel 25 for enabling insertion and removal of a toner cartridge (not shown, but see 70 of FIG. 2). The external housing further includes removable panel 30 for enabling access to the formatter and reversing mechanism (neither of which are visible in FIG. 1, but are shown in FIG. 2 and FIG. 4). The reversing mechanism will be shown and discussed more fully herein and is employed under principles of the present invention for enabling cost effective duplexing.

FIG. 2 is a side elevational view in schematic diagram of printer 10 of FIG. 1. This view depicts the internal media processing paths for single sided and duplex printing. Many of the conventional components are omitted from the drawing to maintain clarity with respect to the media processing paths and duplexing components of the present invention.

Sheet media is stored on biased bed 35 of input tray 15 prior to processing by printer 10. Sensor 40 detects whether sheet media is available on bed 35. Upon initiation of a single sided (no duplex) print job, a sheet is picked from bed 35 by pick roller 45 and passed through transport rollers 50 and skew rollers 55 to photoconductive drum 60 and transfer roller 65 for imaging of the sheet on a first side. Photoconductive drum 60 is disposed in connection with removable toner cartridge 70 as conventional in the art. Once the image is transferred to the first side of the sheet, the sheet continues on through transport rollers 75, fuser 80, transport rollers 82 and sensor 84, and is finally ejected through output rollers 86 into output tray 20 as designated by path indicator 88.

Similarly, upon initiation of a duplex print job, the same processing path just described for non-duplex printing is followed. However, once the sheet reaches output rollers 86, rather than being ejected into output tray 20 (path 88), the sheet is retained by output rollers 86 as indicated by path indicator 90. Subsequently, reversing mechanism 100 reverses the direction of output rollers 86 to draw the sheet back into printer 10 for duplexing purposes. When the sheet is drawn back in, it is guided to follow the duplexing path down through transport rollers 91 and 92 to sensor 93. Upon reaching sensor 93, if it is determined (i.e., by formatter 94, shown in phantom, and discussed more fully later) that data is ready for imaging on the second side of the sheet, the sheet is then transported up and through skew rollers 55 and to photoconductor 60 and transfer roller 65 for imaging of the second side. The second side is presented for imaging because of the inverting effect that occurred to the sheet due to it having been drawn back in through output rollers 86 and subsequently passed down through transport rollers 91 and 92 and back around to photoconductor 60 and transfer roller 65. After being imaged on the second side, the sheet passes again through transport rollers 75, fuser 80, transport rollers 82 and sensor 84, and is finally ejected through output rollers 86 into output tray 20 as designated by path indicator 88.

It should be noted that the processing paths depicted in FIG. 2 are merely exemplary of paths that are used and/or that could be used for duplexing purposes. Other paths are also feasible under principles of the present invention. However, pertinent to the present invention is that all rollers in both paper paths are driven by a single motor 95 for efficiency and cost effectiveness, including reversing mechanism 100. Specifically, for example, in a preferred embodiment shown, all rollers (including the reversing mechanism) are driven by gears embodied in a single gear plate 97 (shown in phantom) that is assembled to printer 10 under removable panel 30 (FIG. 1).

Operation of printer 10 is controlled by a formatter/controller 94 which, in the embodiment shown, is disposed in a plane parallel to and adjacent to gear plate 97. (See also, FIG. 4). Although formatter/controller 94 may in fact be implemented as separate circuit boards (as conventional in the art) with separate functional purposes, they will be referred to herein jointly as the "formatter" for simplicity of discussion purposes. As such, formatter 94 is a control circuit, including firmware, as well known in the art. Formatter 94 also controls/enables reversing mechanism 100 for, selectively, operating it in a "forward" direction such that a sheet is ejected through output rollers 86 and into output tray 20 via path 88, or in a "reverse" direction such that a sheet is pulled back into the duplexing path 90 for duplex processing.

Figure 3:
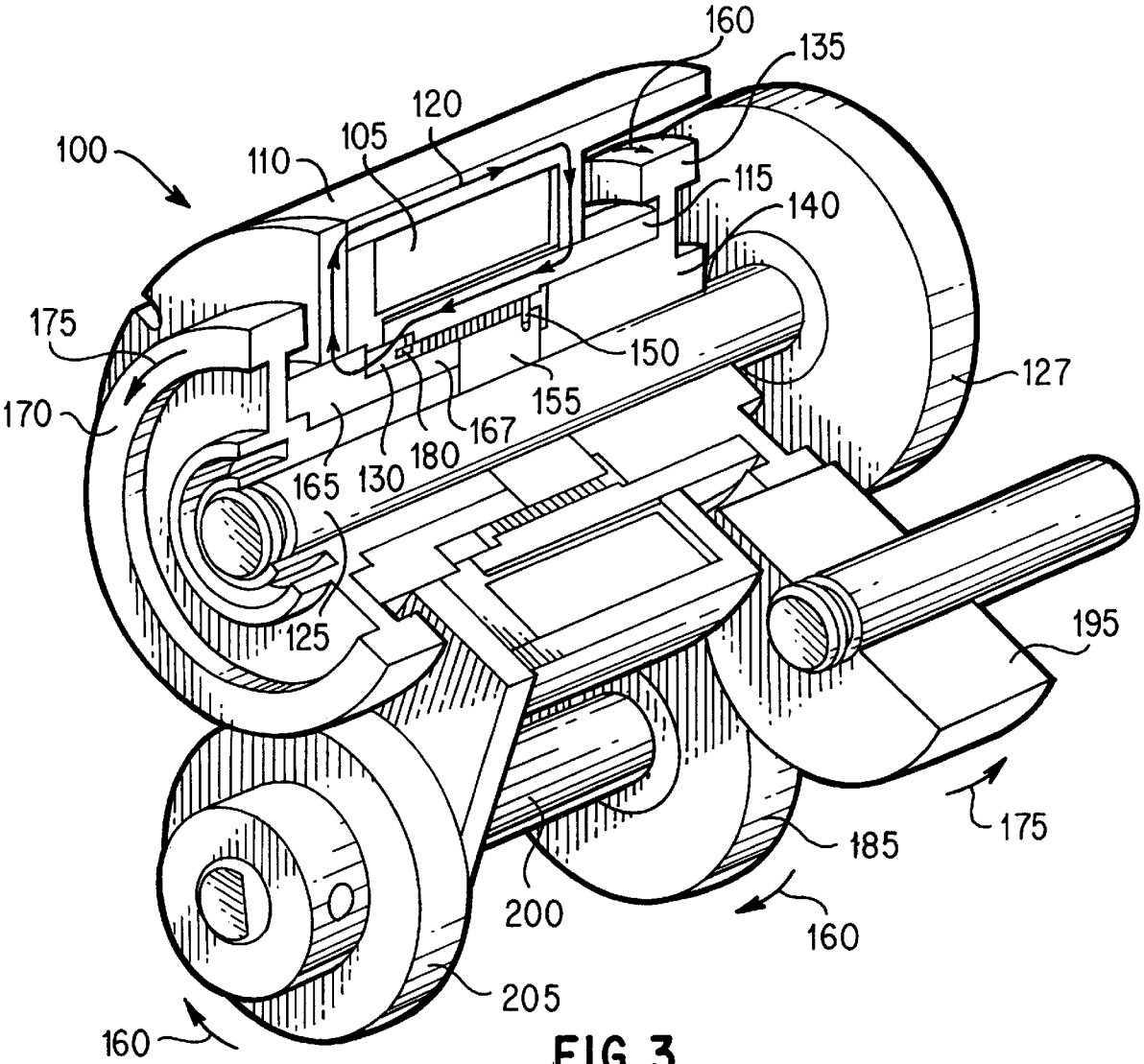
FIG. 3 is a cut away perspective view of the reversing mechanism used with the present invention duplexing system.

Referring now to FIG. 3, a cut away perspective view of reversing mechanism 100 is shown. Reversing mechanism 100 is a single solenoid actuated reversing mechanism designed upon principles similar to, but departing from, a conventional radial electric spring clutch. Conventional clutch devices provide a well known means in the art for enabling high torque capacity with low activation energy. The attraction of a control ring to a shoulder upon energizing of a coil produces the solenoid (or clutch) effect to engage an output with the rotation of an input. Conversely, after electric current is removed from the coil, the magnetic attraction is lost, thus causing the solenoid (or clutch) to disengage.

However, conventional solenoid (or electric clutch) devices enable a rotational engagement in a single direction only. Thus, in the event a bi-directional rotational engagement is needed, two clutches must be used. One to engage in a first direction, and the other to engage in the opposite direction. Or, in the event both clutches engage in the same direction, strategic positioning of the dual clutches relative to each other must occur to obtain the desired result of bi-directional engagement. In either case, the need for dual clutches (solenoids) can be costly and can complicate mechanical design factors for the application or device at issue. Similarly, if two clutches were used with the present invention, overall cost would increase, thus defeating one of the objects of the present invention.

Accordingly, departing somewhat from conventional solenoid devices, reversing mechanism 100 includes stationary coil 105 and casing 110 disposed about an outside perimeter of coil 105, but, importantly, also includes rotatable sleeve 115 disposed on an inside perimeter of coil 105. Thus, a flux path 120 is provided about coil 105 through stationary casing 110 and rotatable sleeve 115 to enable solenoid actuation. Additionally, rotatable sleeve 115 provides a means for engaging output shaft 125 and output gear 127 (which is fixedly attached to output shaft 125) in a direction that is reversed from that provided by energizing coil 105 as will be discussed more fully herein.

Generally speaking, sleeve 115 is continuously rotated about output shaft 125 by gear 135 in a first ("forward") direction denoted by directional arrow 160. Sleeve 115 is fixedly attached to shoulder 140 of gear 135. Thus, when gear 135 is rotated, sleeve 115 is rotated. As sleeve 115 is rotated, wrap spring 145 is self-energized against the inside perimeter of sleeve 115 (assuming coil 105 is not energized). Namely, wrap spring 145 and sleeve 115 are disposed close enough to each other such that wrap spring 145 is expanded by the rotation of sleeve 115 and is engaged therewith. Since one end 150 of wrap spring 145 is attached to hub 155 which is fixedly attached to output shaft 125, the expansion of spring 145 against sleeve 115 engages output shaft 125 into "forward" rotation with sleeve 115 (and gear 135) as shown by directional arrow 160. Advantageously, output shaft 125 (and output gear 127) are also free wheeling in the "forward" direction, meaning that the shaft may be rotated (by some external force not shown) faster than, but not less than, the rotational velocity of sleeve 115 when coil 105 is not energized.

On the other hand, shoulder 165 and neck 167 are fixedly attached to gear 170 and together are continuously rotated about output shaft 125 in a second ("reverse") direction denoted by directional arrow 175. When coil 105 is energized, floating control ring 130 is attracted to shoulder 165. Since the other end 180 of wrap spring 145 is attached to control ring 130, spring 145 wraps down onto neck 167 (of shoulder 165) and hub 155 as gear 170 is rotated. To this end, torque is transferred from the input (shoulder 165, neck 167 and gear 170), through spring 145, to hub 155 and output shaft 125, thereby causing output shaft 125 to also rotate in the "reverse" direction 175.

Stepping back to look at the gearing and drive means associated with reversing mechanism 100, input gear 185 (or, alternately, shaft 200) receives a force in a "forward" rotational direction 160 from an exterior source (not shown). Gear 185 rotates gear 135 also in the forward direction via idler gear 195. As discussed, gear 135 is attached to shoulder 140 which is attached to sleeve 115. Thus, again, sleeve 115 continuously rotates in the "forward" direction 160 as driven by input gear 185 through idler gear 195.

To effectuate the "reverse" direction 175, input gear 185 is attached to shaft 200 which is attached to gear 205. Gear 205 directly drives gear 170. Since gear 205 rotates in the "forward" direction with input gear 185, and since gear 205 directly drives gear 170, gear 170 is thereby continuously driven in the "reverse" direction 175.

All the gears 127, 135, 170, 185, 195, and 205 are shown in the Figure without teeth for simplicity of drawing purposes. However, it will be understood by those of ordinary skill in the art that any conventional means may be used to effectuate the gearing interconnections. For example, teeth may be used to interconnect the gears, or a direct drive pressed interface may be used between the gears, or the gears may be belt connected. Additionally, "connected" or "interconnected" means directly connected or indirectly connected through other components and/or gears.

All in all, the gearing described effectuates a continuous rotation of sleeve 115 in a "forward" direction and, simultaneously, a continuous rotation of shoulder 165 in a "reverse" direction. It should be noted, however, that the directional labels of "forward" and "reverse" are not absolute but may be interchanged, depending upon perspective. But as per the drawing, with the "forward" rotation 160 shown, spring 145 self energizes against sleeve 115 as the spring is expanded away from hub 155 in response to the "forward" rotation of sleeve 115. Thus, spring 145 engages sleeve 115 with shaft 125 (via hub 155) and continuously rotates output shaft 125 (and output gear 127) in the "forward" direction so long as coil 105 remains not energized. However, as soon as coil 105 is energized, flux 120 causes control ring 130 to be attracted to rotating shoulder 165, thereby tightening the diameter of spring 145 and engaging it down against hub 155 and neck 167 of shoulder 165 so that the spring no longer is self energized against sleeve 115. Thus, spring 145 engages rotating shoulder 165 with shaft 125 (via hub 155) and thereby causes output shaft 125 and output gear 127 to be rotated in the "reverse" direction.

Referring now to FIG. 4, a partial perspective view of printer 10 is depicted with cover panel 30 (FIG. 1) removed. FIG. 4 depicts the strategic location and integration of reversing mechanism 100 (of FIG. 3) on printer 10 for enabling duplexing. In the embodiment shown, reversing mechanism 100 is integrated into base 210 which is attached to gear plate 97 by screws 215. Protective shield 220 is disposed over formatter 94 (shown in phantom). The ends of pins 230 are shown extending through gear plate 97. Pins 230 support gears on the interior surface of gear plate 97 that drive rollers in the media processing paths of printer 10. (The interior surface of gear plate 97 and the gears thereon are not shown because they face toward the center of printer 10). One of the gears on the interior surface of gear plate 97 drives a gear (not shown) that is attached to shaft 200 of reversing mechanism 100 for driving the reversing mechanism. All of the gears on the interior surface of gear plate 97 are driven by the single motor 95 (FIG. 2) for operating printer 10. To this regard (and as previously discussed with respect to FIG. 3), as shaft 200 is driven (of reversing mechanism 100) in the "forward" direction, gear 185 is driven in the "forward" direction, thus turning idler gear 195 in the "reverse" direction and gear 135 (see FIG. 3) in the "forward" direction and, consequently, shaft 125 and output gear 127 (both not shown, but see FIG. 3) in the "forward" direction (when coil 105 is not energized) for driving output rollers 86 in the "forward" direction. Output gear 127 may be connected directly or indirectly to output rollers 86. Additionally, as gear 185 is driven in the "forward" direction, gear 205 is driven in the forward direction, gear 170 is driven in the "reverse" direction, and, consequently, shaft 125 (FIG. 3) is driven in the "reverse" direction (when coil 105 is energized) for driving output rollers 86 in the "reverse" direction for duplexing purposes.

Although base 210 is shown as being attached to gear plate 97 by screws 215, it will be obvious that it may be attached by other conventional means in the art, such as being snap or twist fitted into operative cooperation with gear plate 97. Additionally, under the present invention, reversing mechanism 100 is cooperatively fitted (via base plate 210) with gear plate 97 such that a non-reversing mechanism (not shown) may be substituted in the place of reversing mechanism 100. Such a non-reversing mechanism may be any conventional direct drive/gear device, or any conventional solenoid activated device for driving output rollers 86 in the "forward" direction only. If such a non-reversing mechanism is used, then, obviously, duplexing is disabled as the sheet media would always be ejected through output rollers 86 into output tray 20 (path 88) and would not ever be drawn back into the duplexing path 90 because the output rollers 86 would not be reversible. However, this interchangeable feature of reversing mechanism 100 in connection with printer 10 presents a novel aspect of the present invention. Specifically, by initially integrating substantially all of the duplexing features into printer 10, except for reversing mechanism 100, the printer may be provided to a customer at a reduced price as a non-duplexing printer. This is because reversing mechanism 100 is a single source of a significant amount of cost for enabling duplexing of printer 10. Thus, by optionally leaving it out of the printer, that cost is avoided. The remaining duplexing components, such as the transport rollers 91 and 92, and media sensor 93, are relatively inexpensive to include in printer 10. Similarly, the forming of duplexing path 90 into the printer is also relatively inexpensive. Additionally, the duplexing control functionality incorporated into formatter 94 is of minimal cost because the formatter and associated firmware often already include duplexing as a base optional feature. As such, the overall costs for including generally all of the duplexing features except for reversing mechanism 100 into printer 10 is relatively inexpensive. Thus, the customer may be provided a low cost, non-duplexing system.

On the other hand, if a customer originally purchased a non-duplexing version of printer 10 at the reduced cost (i.e., reversing mechanism 100 excluded), but later wanted to upgrade to a duplexing system, then reversing mechanism 100 can be provided as an "upgrade kit" for enabling duplexing functionality relatively inexpensively and easily. The customer or support person simply removes panel 30, removes the non-reversing output drive roller mechanism, and then installs reversing mechanism 100. To this regard, another novel aspect of the present invention includes the fact that reversing mechanism 100 is disposed in printer 10 at a strategic location that is easily accessible by a customer. In the embodiment shown, this location is under removable panel 30 and at an easily accessible portion of gear plate 97. Moreover, the upgrade is relatively inexpensive as the additional cost lies mostly in the acquisition of a single solenoid activated reversing mechanism 100 rather than other conventional and more expensive dual solenoid activated reversing mechanisms or dual motor configurations.

All in all, with the present invention printer 10, through extensive integration of relatively inexpensive duplexing functionality into the base engine, duplex capability can be subsequently added with relative ease of installation and minimal cost.

Finally, it will be obvious to one of ordinary skill in the art that the present invention is easily implemented utilizing any of a variety of components existing in the art. Moreover, while the present invention has been described by reference to specific embodiments, it will be apparent that other alternative embodiments and methods of implementation or modification may be employed without departing from the true spirit and scope of the invention.

What is claimed is:

1. An image forming device comprising:

(a) output rollers disposed for ejecting media out of the image forming device; and, (b) a single solenoid activated bi-directional output drive mechanism connected to the output rollers for bi-directionally driving the output rollers and for enabling a return path for duplexing of the media, wherein the output drive mechanism comprises:

(i) an output shaft disposed in association with a solenoid mechanism;

(ii) a first mechanism rotatingly disposed about the output shaft for driving the output shaft in a first direction in response to a non-activation of the solenoid mechanism, wherein the first mechanism includes a sleeve disposed about the output shaft on an inside perimeter of a coil winding of the solenoid mechanism; and, (iii) a second mechanism rotatingly disposed about the output shaft for driving the output shaft in a second direction in response to an activation of the solenoid mechanism.

2. The image forming device of claim 1 further including a wrap spring disposed about the output shaft on an inside perimeter of the first mechanism and having one end attached to the output shaft and an opposite end attached to the solenoid mechanism, the wrap spring for engaging the first and second mechanisms with the output shaft respectively.

3. The image forming device of claim 1 further including a drive mechanism for driving a photoconductive element of the image forming device, and wherein the drive mechanism is further connected to the output drive mechanism for driving the output drive mechanism in the first rotational direction, and whereby the output drive mechanism drives the output rollers in the first rotational direction for ejecting media out of the image forming device.

4. The image forming device of claim 3 further including control means for activating the solenoid mechanism such that the output drive mechanism drives the output rollers in the second rotational direction for enabling the return path for duplexing of the media.

5. The image forming device of claim 1 further including an exterior housing enclosing the image forming device, and wherein the output drive mechanism is removably attached to the image forming device at a location internal to the exterior housing and at a location that is accessible upon removal of at least a portion of the exterior housing, thereby enabling access and removal of the output drive mechanism upon demand.

6. The image forming device of claim 5 wherein the output drive mechanism is removably attached such that a uni-directional drive mechanism may be substituted therefor for driving the output rollers in a single direction for ejecting media out of the image forming device.

7. An image forming device comprising:

(a) output rollers disposed for ejecting media out of the image forming device; and, (b) a single solenoid-activated bi-directional output drive mechanism connected to the output rollers for bi-directionally driving the output rollers and for enabling a return path for duplexing of the media, wherein the output drive mechanism comprises:

(a) a stationary coil disposed about an axis, the coil having a casing disposed about an outside perimeter of the coil and a sleeve disposed on an inside perimeter of the coil, the sleeve being rotatable about the axis, and whereby a magnetic flux path is provided through the stationary case and rotatable sleeve when the coil is energized;

(b) first driving means attached to the rotatable sleeve for driving the sleeve in a first direction about the axis;

(c) a shaft disposed through the sleeve and rotatable about the axis;

(d) a solenoid mechanism rotatably disposed about the shaft opposite the first driving means;

(e) second driving means operatively connected to the solenoid mechanism for driving the solenoid mechanism in a second direction; and, (f) engagement means disposed about the shaft for engaging the rotatable sleeve to the shaft for driving the shaft in the first direction when the coil is not energized, and for engaging the solenoid mechanism to the shaft for driving the shaft in the second direction when the coil is energized.

8. The image forming device of claim 7 wherein the solenoid mechanism includes a floating control ring and a shoulder, and wherein the engagement means includes a spring wrapped around the shaft with one end attached to the shaft, directly or indirectly, and an opposite end attached to the floating control ring, and wherein when the coil is not energized the spring self energizes against an inside perimeter of the sleeve for driving the shaft in the first direction, and wherein when the coil is energized the spring is drawn down against the shaft as the floating control ring is attracted to the shoulder for releasing the spring from the inside perimeter of the sleeve and for driving the shaft in the second direction.

9. An image forming device comprising:

(a) a print engine;

(b) output rollers disposed for ejecting media out of the image forming device after the media is processed by the print engine; and, (c) an output drive mechanism coupled to the output rollers for bi-directionally driving the output rollers and for enabling a return path for duplexing of the media, wherein the output drive mechanism comprises:

(i) an output shaft disposed in association with a solenoid apparatus;

(ii) a sleeve rotatingly disposed about the output shaft on an inside perimeter of a coil winding of the solenoid apparatus for driving the output shaft in a first rotational direction in response to a non-activation of the solenoid apparatus;

(iii) a floating control ring rotatingly disposed about the output shaft for driving the output shaft in a second rotational direction in response to an activation of the solenoid apparatus; and, (iv) a wrap spring disposed about the output shaft adjacent an inside perimeter of the sleeve, the wrap spring having a first end attached to the output shaft, directly or indirectly, and a second end attached to the floating control ring, the wrap spring for engaging, alternatively, the sleeve and floating control ring with the output shaft.

10. The image forming device of claim 9 further including a drive mechanism for driving a photoconductive element of the image forming device, and wherein the drive mechanism is further coupled to the output drive mechanism for driving the output drive mechanism in the first rotational direction, and whereby the output drive mechanism drives the output rollers in the first rotational direction for ejecting media out of the image forming device.

11. The image forming device of claim 10 further including control means for activating the solenoid apparatus such that the output drive mechanism drives the output rollers in the second rotational direction for enabling the return path for duplexing of the media.

12. The image forming device of claim 9 further including an exterior housing enclosing the image forming device, and wherein the output drive mechanism is removably attached to the image forming device at a location internal to the exterior housing and at a location that is accessible upon removal of at least a portion of the exterior housing, thereby enabling access and removal of the output drive mechanism upon demand.

13. The image forming device of claim 12 wherein the output drive mechanism is removably attached such that a unidirectional drive mechanism may be substituted therefor for driving the output rollers in a single direction for ejecting media out of the image forming device.

14. The image forming device of claim 9 wherein the solenoid apparatus further includes a shoulder, and wherein in the event the coil winding is not energized the spring self energizes against the inside perimeter of the sleeve for driving the shaft in the first rotational direction, and wherein in the event the coil winding is energized the spring is drawn down against the shaft as the floating control ring is attracted to the shoulder for releasing the spring from the inside perimeter of the sleeve and for driving the shaft in the second rotational direction.

* * * * *